US007603882B2

(12) United States Patent
Carbajal et al.

(10) Patent No.: US 7,603,882 B2
(45) Date of Patent: Oct. 20, 2009

(54) ELECTRIC DOOR LOCK SYSTEM FOR REFRIGERATED DISPLAY CASES

(75) Inventors: Frank J. Carbajal, La Crescenta, CA (US); Matthew Rolek, Valencia, CA (US)

(73) Assignee: Anthony, Inc., Sylmar, CA (US)

( * ) Notice: Subject to any disclaimer, the term of this patent is extended or adjusted under 35 U.S.C. 154(b) by 305 days.

(21) Appl. No.: 11/521,983

(22) Filed: Sep. 15, 2006

(65) Prior Publication Data

US 2008/0066506 A1 Mar. 20, 2008

(51) Int. Cl.
*E05B 43/00* (2006.01)

(52) U.S. Cl. ..... 70/267; 70/257; 70/277; 292/201

(58) Field of Classification Search ..... 70/277, 70/256, 267, 254; 292/227, 229, 231, 201
See application file for complete search history.

(56) References Cited

U.S. PATENT DOCUMENTS

| | | | | | |
|---|---|---|---|---|---|
| 1,736,761 | A | | 11/1929 | Haffner | |
| 1,989,419 | A | * | 1/1935 | Hill | 70/267 |
| 2,677,814 | A | | 5/1954 | Miller | |
| 2,960,046 | A | * | 11/1960 | Clark | 110/191 |
| 3,377,092 | A | | 4/1968 | Rohman | |
| 3,576,337 | A | | 4/1971 | Gudde | |
| 3,643,479 | A | | 2/1972 | Solow | |
| 3,749,435 | A | | 7/1973 | Balzano | |
| 3,751,088 | A | * | 8/1973 | Schlage | 292/201 |
| 3,890,608 | A | * | 6/1975 | Peterson | 340/522 |
| 3,988,859 | A | | 11/1976 | Peterson | |
| 4,099,752 | A | * | 7/1978 | Geringer | 292/144 |
| 4,126,341 | A | * | 11/1978 | Bradstock | 292/201 |
| 4,141,610 | A | | 2/1979 | Ando | |
| 4,470,625 | A | * | 9/1984 | Walsh et al. | 292/201 |
| 4,509,347 | A | * | 4/1985 | Young | 70/129 |
| 4,579,376 | A | * | 4/1986 | Charlton | 292/144 |
| 4,691,542 | A | * | 9/1987 | Young | 70/129 |
| 4,881,766 | A | * | 11/1989 | Schmidt et al. | 292/201 |
| 4,913,475 | A | | 4/1990 | Bushnell et al. | |
| 5,284,371 | A | * | 2/1994 | Richardson et al. | 292/149 |
| 5,339,662 | A | * | 8/1994 | Goldman | 70/277 |
| 5,755,126 | A | * | 5/1998 | Lanigan et al. | 70/257 |
| 5,871,263 | A | * | 2/1999 | Johnston et al. | 312/217 |

(Continued)

*Primary Examiner*—Suzanne D Barrett
(74) *Attorney, Agent, or Firm*—Jeffer Mangels Butler & Marmaro LLP

(57) ABSTRACT

An electric door lock assembly including a solenoid having a plunger movable between retracted and extended positions, and a mounting bracket for mounting the solenoid to a door or door frame so that the plunger operatively moves along a vertical axis between the retracted and extended positions. A locking arm or bolt is pivotally connected at a proximal end thereof to the plunger. A connecting arrangement causes rotational and linear pivoting of the arm relative to a horizontal axis as the plunger is moved between the retracted and extended positions such that a distal end of the arm moves between unlocked and locked positions relative to a keeper in the door. This arrangement can include the locking arm having an elongate axial slot in which a fixed pin of the mounting bracket is positioned; the pivot pin defining the horizontal axis. The proximal end of the locking arm is pivotally connected to the bottom end of the plunger. Thereby, as the plunger travels up and down the proximal end moves up and down, and the locking arm slides relative to the pin, resulting in the rotational and linear pivoting.

28 Claims, 7 Drawing Sheets

U.S. PATENT DOCUMENTS 6,367,223 B1 * 4/2002 Richardson et al. ..... 52/656.9
6,578,978 B1 * 6/2003 Upton et al. ..... 362/92
6,745,603 B1 * 6/2004 Shaw ..... 70/278.1
7,295,110 B2 * 11/2007 Mercier et al. ..... 340/545.6
7,296,448 B1 * 11/2007 Shaw ..... 70/283
2002/0180580 A1 * 12/2002 Gotfried ..... 340/5.2
2005/0144991 A1 * 7/2005 Bravo et al. ..... 70/56
2005/0183480 A1 * 8/2005 Hingston et al. ..... 70/279.1
2007/0152455 A1 * 7/2007 Ko et al. ..... 292/201

* cited by examiner

ELECTRIC DOOR LOCK SYSTEM FOR REFRIGERATED DISPLAY CASES

BACKGROUND OF THE INVENTION

Refrigerated display cases are used in liquor stores, convenience stores, food vending establishments, and other facilities to keep food and beverage products cold, thereby to keep them fresh and/or to maintain them at desired cold consumable temperatures, or for some display cases to keep the products frozen. The products can be accessed by customers by sliding or pivoting the case doors open. The doors typically have transparent windows allowing customers to view the stored products before opening the doors to help the customers quickly determine whether the desired product is in the case before opening the door. This not only makes it easier for the customer but also reduces the frequency and length of time that the door is open and prevents ambient heat being transferred into the refrigerated display case.

The refrigerated display case doors can have mechanical key-actuated locks to individually lock each of the doors when the facility is closed to the public to prevent theft from the cases. Also, some or all of the doors in the cases in the facility can be locked when the facility is open to prevent customer access to the products in those specific cases. For example, in some areas of the country, beer, wine and other cold alcoholic beverages cannot be sold on certain days or at certain times of the day without violating local laws. In those jurisdictions, proprietors of facilities (such as convenience stores) where beer, wine and the like are sold from refrigerated display cases may voluntarily or may be required to lock the doors of their refrigerated display cases which contain such products when their facilities are open to the public to sell other products during those days and at those times. They do so using the above-mentioned individual key locks for each of the doors.

SUMMARY OF THE INVENTION

In accordance with the invention, an electric door lock assembly embodiment thereof includes a mounting bracket adapted to be mounted to a door or a door frame, a pull-type (or push-type) solenoid secured to the bracket and having a plunger, a pivot pin secured to the bracket, and a bolt (or locking arm) pivotally connected at one end to the plunger and having an elongate slot in which the pivot pin is disposed. The solenoid, when electrically energized, moves the plunger from an extended position to a retracted position, which causes the bolt to pivot about the pivotal connection and also to simultaneously pivot and linearly slide relative to the pivot pin. Thereby the bolt is moved from an unlocked position to a locked position. Alternatively, the assembly can be constructed such that the bolt is moved from the locked to the unlocked position when the solenoid is energized. This electric door lock assembly can be used to lock doors of refrigerated display cases and the like.

According to another aspect of the invention, an electrical door lock assembly embodiment thereof includes a solenoid having a plunger movable between retracted and extended positions, and mounting means for mounting the solenoid to a door or to a door frame so that the plunger is vertically disposed and operatively moves along a vertical axis between the retracted and extended positions. A locking arm is pivotally connected at a proximal end thereof to the plunger. Pivoting means causes rotational and linear pivoting of the arm relative to a horizontal axis as the plunger is moved between the retracted and extended positions, which moves a distal end of the arm between door unlocked and locked positions.

The invention can be implemented to achieve one or more of the following advantages. A timing mechanism can be operatively connected to the solenoid of the door lock assembly to energize the solenoid and thereby move the assembly to a locked position automatically at one or more predetermined times or days. Further, the timing mechanism can be operatively connected to the solenoids of a plurality of the door lock assemblies within the facility to simultaneously lock them at the predetermined times. For example, if a local law in the jurisdiction of the facility requires that no beer or wine may be sold after 5 p.m. on Saturday, the timing mechanism can be set so that all of the doors to all of the facility's display cases which have beer or wine in them are automatically locked at 5 p.m. every Saturday or shortly before that time.

This timing mechanism helps ensure that the facility complies with that local law. The facility employees need not remember or take the time away from their other work duties to individually lock each of the doors. It further does not require that the employees have keys to lock the doors, keys which can become lost, broken or misused. Additionally, the display cases and the timing mechanism can be used such that only doors accessing display cases having beer or wine in them will be locked; and those which do not have beer or wine in them but rather have food, non-alcoholic drinks (e.g., soft drinks) and so forth, will not be locked, or are locked at different times.

The above-mentioned timing mechanism can also be adapted to automatically unlock all of the locked doors at the appropriate time, such as at the opening time of the facility the following morning. This would ensure that all of the display doors are unlocked, thereby not frustrating or discouraging customers who try to open a locked display case door, and would also save the employees the time and trouble of unlocking the doors, especially if the locks are key-locks and the keys cannot be located.

According to a further aspect of the invention, a door locking and/or unlocking method including the step of at least one of energizing or de-energizing a solenoid of a door lock assembly connected to a door is disclosed. The solenoid is mounted so that its plunger is operatively movable between retracted and extended positions. The door lock assembly includes a locking arm pivotally connected at a first end to the plunger and means for causing concurrent rotational and linear movement, about a pivot pin whose axis is fixed relative to the door or door frame, of a second end of the locking arm between door locked and unlocked positions-relative to a keeper as the solenoid is energized and/or de-energized.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
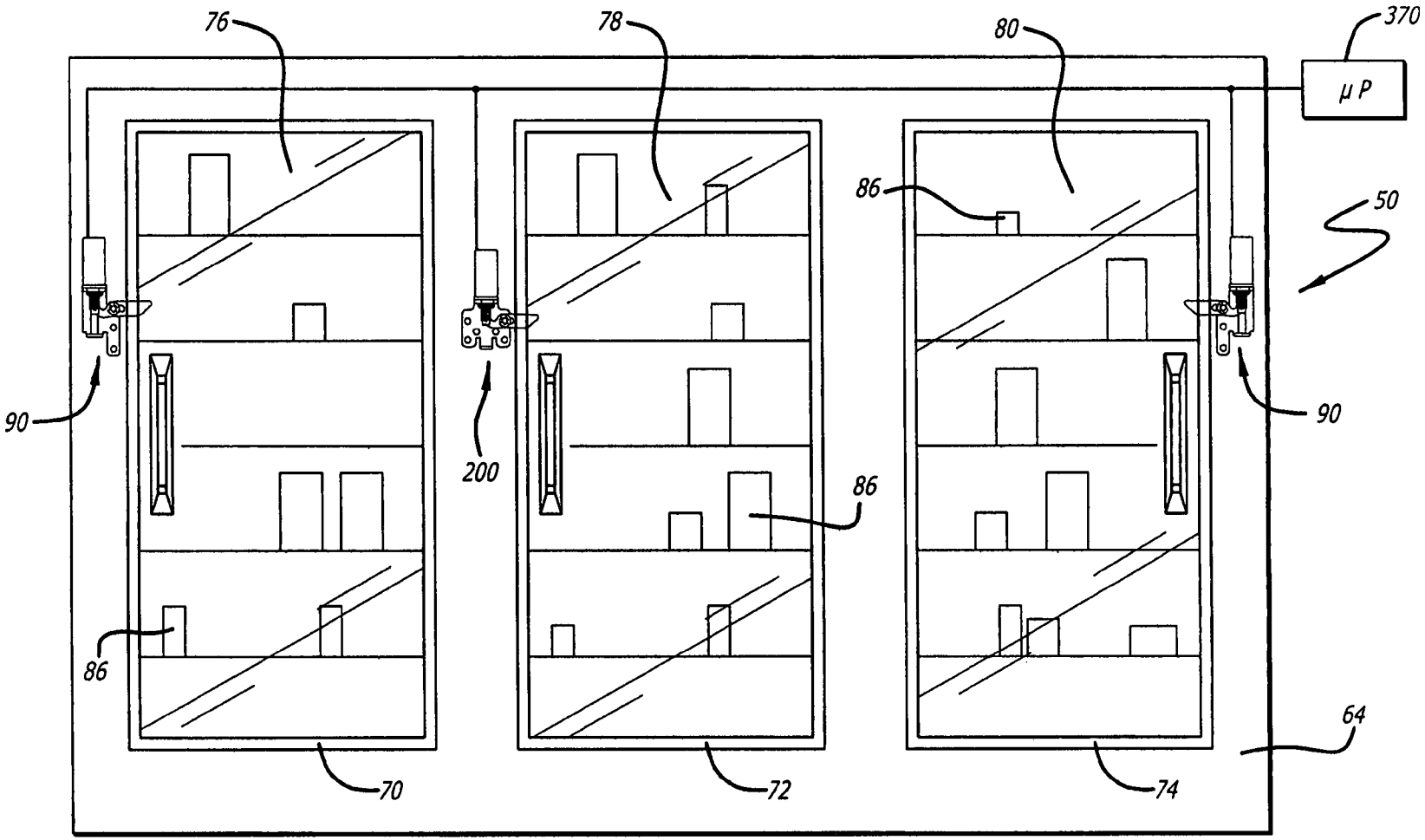
FIG. 1 is a front elevational view of a refrigerated display case of the present invention.

Referring to the drawings wherein like reference numerals in the various drawings indicate like parts, a refrigerated display case is shown in FIG. 1 generally at 50 positioned in a facility, such as a grocery or convenience store. The refrigerated display case 50 can include enclosure-forming walls, including a front wall 64. The case 50 has a suitable cooling system, such as cooling coils and fans (not shown and as would be known to those skilled in the refrigerated display case art), for keeping the contents at the desired cold temperature. Examples of display cases are disclosed in U.S. Pat. No. 5,675,983 (Ibrahim), U.S. Pat. No. 6,318,027 (Richardson, et al.), U.S. Pat. No. 6,367,223, (Richardson, et al.), U.S. Pat. No. 6,578,978 (Upton, et al.). (The entire contents of each of these patents and all other patents and other documents mentioned anywhere in this disclosure are hereby incorporated by reference.)

Wall 64 can have one or more customer-access openings, and three are depicted in the embodiment of FIG. 1. Doors 70, 72 and 74, preferably having transparent windows 76, 78 and 80 and maybe having a temperature insulation layer, are provided at each opening. The doors can be opened to provide access for the customers to the contents 86 of the case 50, and subsequently closed to protect the case contents and also to keep the cold air in the case 50. The doors 70, 72 and 74 can be swing-type hinged doors or sliding doors. Each door 70, 72, 74 can be equipped with an electric door lock assembly of the present invention, as described in detail below.

Figure 2:
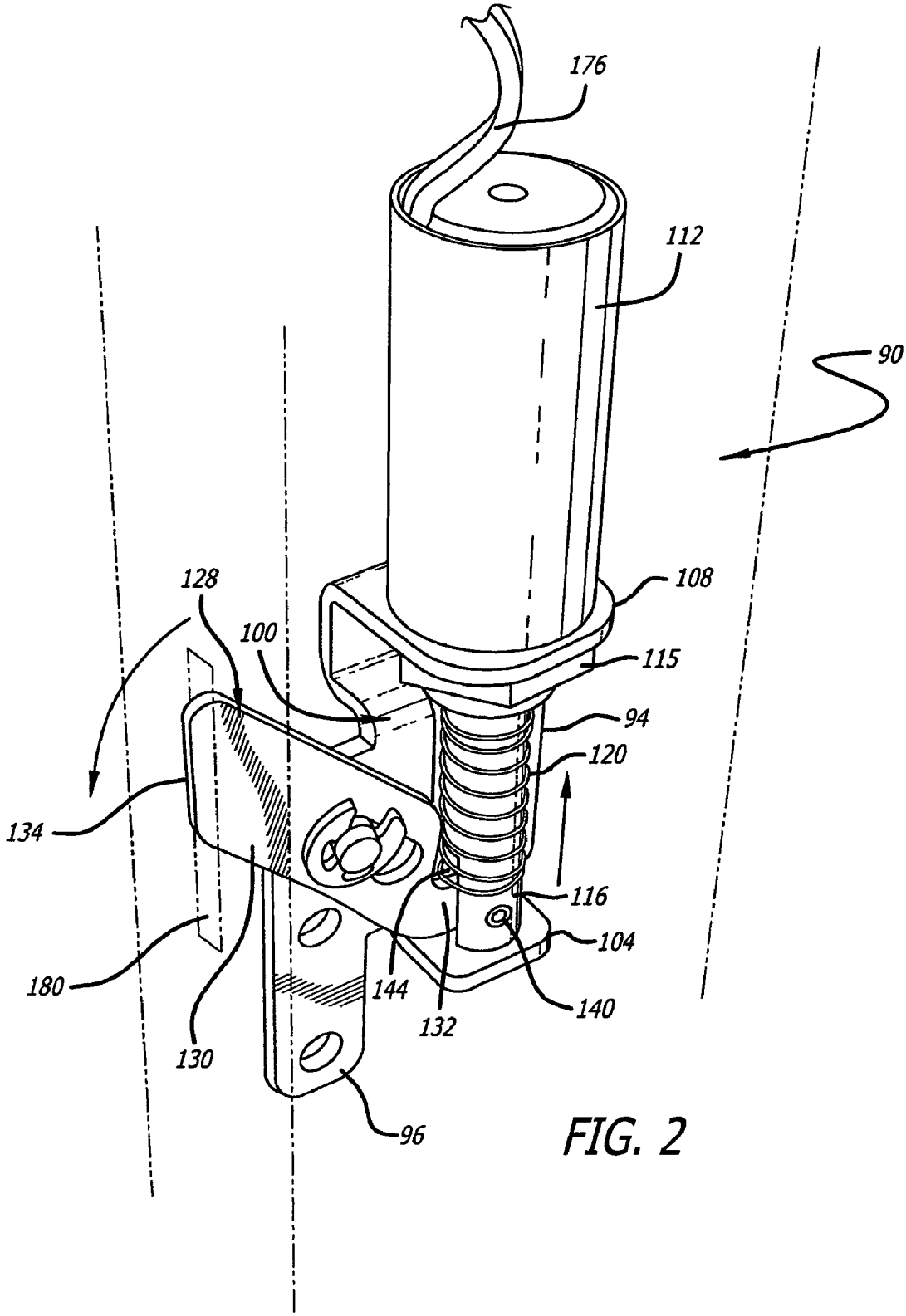
FIG. 2 is an enlarged perspective view of one of the electric door lock assemblies of FIG. 1 illustrated in isolation.
Figure 4:
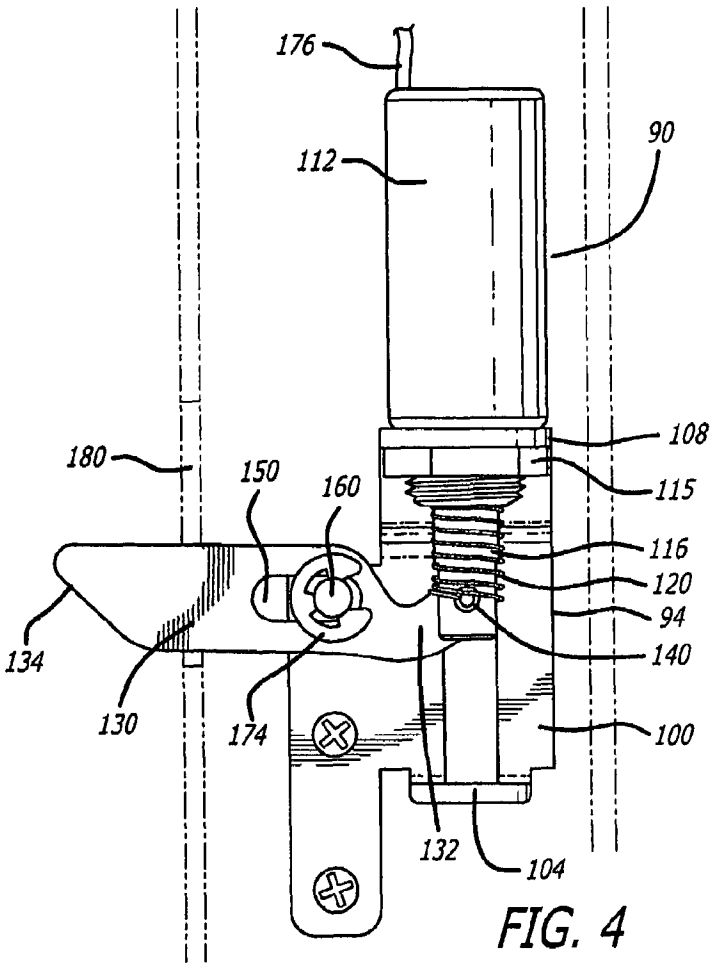
FIG. 4 is a front elevational view of the lock assembly of FIG. 2 in a locked position.
Figure 3:
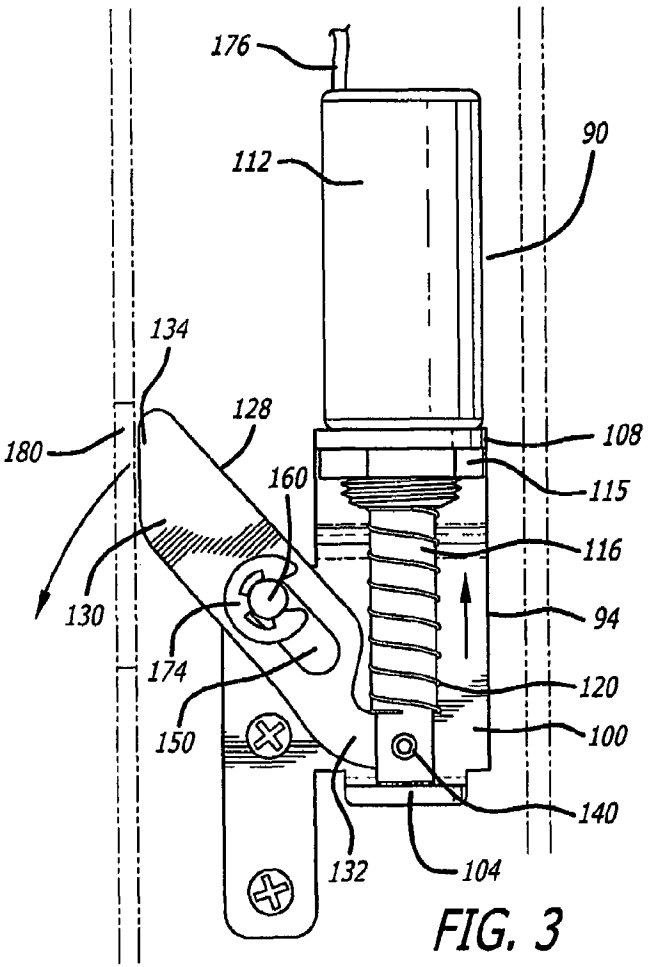
FIG. 3 is a front elevational view of the lock assembly of FIG. 2 in an unlocked position.

The electric door lock assembly of the present invention can have a number of embodiments, a first of which is illustrated generally at 90 in FIGS. 2-4. The bracket 94 of the door lock assembly 90 can have an outside leg 96 because of the mounting and operating geometries involved. The back plate 100 of the mounting bracket 94, which includes the leg 96, has a pair of spaced outwardly-extending plates 104, 108, disposed one above the other. The top plate 108 has a hole through which the threaded end of a solenoid 112 is inserted, and the solenoid is then secured in place on top of the top plate by threading a nut 115 onto the threaded end. An example of a suitable solenoid 112 is the "Saia—Burgess, Inc., 195204-233 STA® Solenoid, Gage 81840 0525." The bottom plate 104 defines an abutment support plate for the lower end of the solenoid plunger 116 when in the extended position, as depicted in FIGS. 2 and 3. The plunger 116 is illustrated in a retracted position in FIG. 4, and is returned to its extended position, such as when the solenoid 112 is de-energized, by the action of gravity and of the return spring 120 disposed around the plunger.

The electric door lock assembly 90 also includes a locking bolt 128 which can be shaped as a flat locking arm 130 having a hooked or curved proximal end 132 and an angled distal or working end 134. The proximal end 132 is attached with a pivotal connection 140 in a bottom slot 144 of the plunger 116. The arm 130 has a slot 150 disposed along the longitudinal axis of the arm and down the middle of the arm. Although the slot 150 is depicted in the drawing figures as a through-slot, it alternatively can be configured as a channel.

Mounted perpendicular to the back plate 100 of the mounting bracket 94 and generally between but outside of the top and bottom plates 104, 108 is a pivot pin 160. The pivot pin 160 extends up (or out) through the slot 150. The arm 130 can pivot about and slide along the pivot pin 160, as will be described below. A standoff on (or affixed to) the pivot pin 160 and inside of the arm and a retaining ring 174 on the pivot pin and outside of the arm 130, together hold the arm relative to the pivot pin while still allowing the pivotal and sliding movement of the arm relative to the pivot pin, which is disposed in the slot 150.

When it is desired to lock the door, the solenoid 112 is energized by current flowing through the lead wires 176, which creates an electromagnetic field in the solenoid, drawing the (metallic) plunger 116 up from the extended position of FIGS. 2 and 3, and into the retracted position of FIG. 4. As the plunger is lifted 116, the proximal end 132 of the arm 130 is lifted by and pivoted about the pivotal connection 140. This movement causes the arm 130 to pivot about and slide along the pivot pin 160. The arm 130 slides along and relative to the pivot pin 160 in the slot 150 so that its distal working end 134 is farther away from the pivot pin. And the arm 130 pivots so that its working end 134 is pivoted downwardly (or upwardly) from about an eleven o'clock position to about a nine o'clock position. The working distal end 134 thereby sticks out a distance and into the keeper 180 in the door (or in the door frame).

To unlock the lock assembly, the solenoid 112 is de-energized. This releases the plunger 116 from its retracted position of FIG. 4; and gravity and the return spring 120 return the plunger to its extended position, as depicted in FIG. 3. This downward motion of the plunger 116, causes the proximal end 132 of the locking arm 130 to travel down with the pivotal connection 140 at the lower end of the plunger and to pivot about that pivotal connection. At the same time, the locking arm 130 slides along and pivots about the pivot pin 160, until the arm is in about the eleven o'clock position and the working distal end 134 is lifted out and away from the keeper 180, into the unlocked position.

The energizing and de-energizing of the solenoid 112 can be programmed to occur automatically at the desired times and days. For example, as discussed in the Summary of the Invention section above, if the law in the jurisdiction prohibits the sale of beer and wine after 5 p.m. on Saturdays, the solenoid 112 can be programmed to be energized (or de-energized) and cause the locking arm 130 to move to the locked position at 5 p.m. (or shortly before) on Saturdays. The construction and operation of a suitable programming and energizing mechanism would be readily apparent to those of ordinary skill in the art from this disclosure.

Figure 5A:
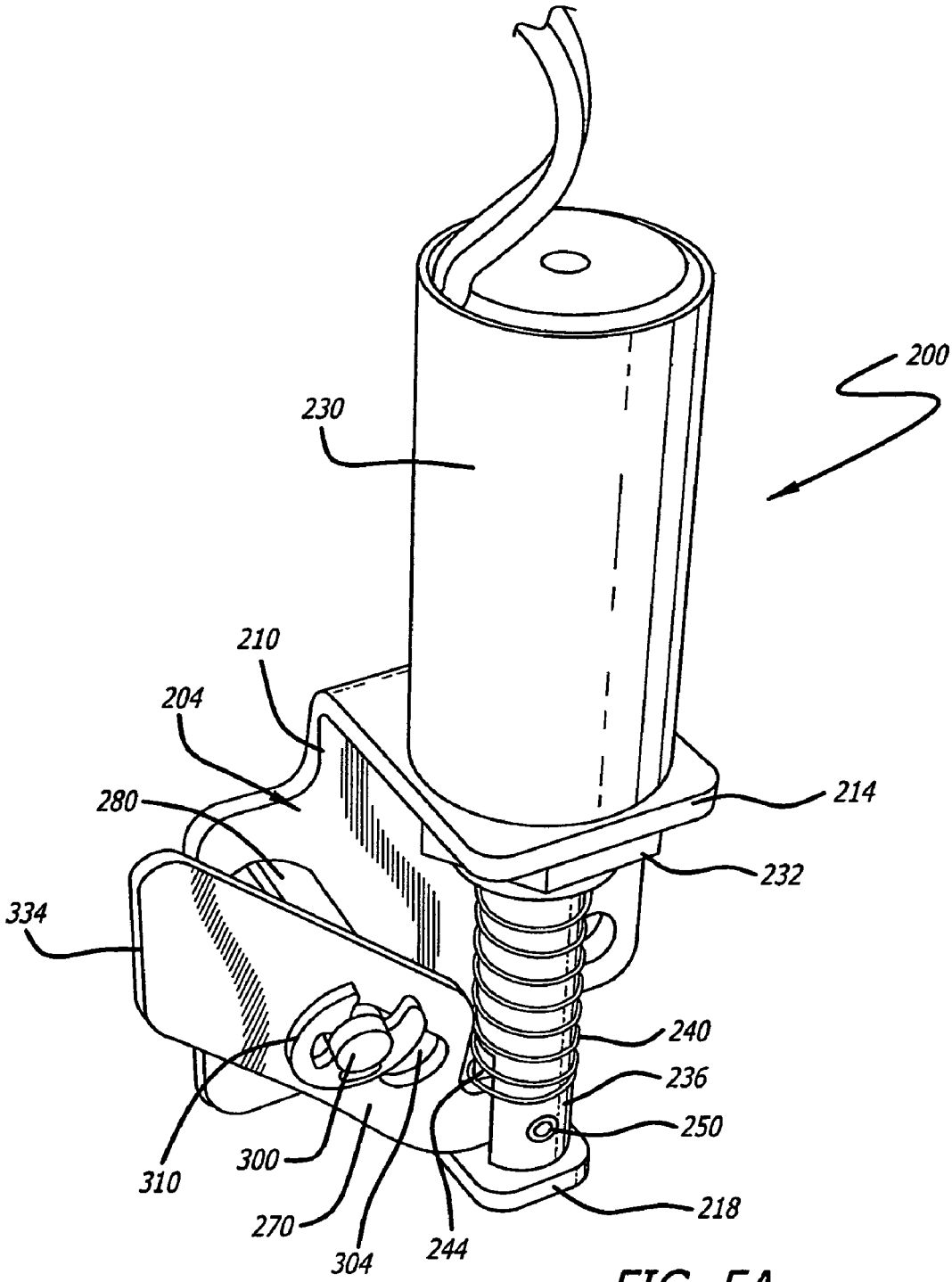
FIG. 5A is an enlarged perspective view of another one of the electric door lock assemblies of FIG. 1 illustrated in isolation.
Figure 5B:
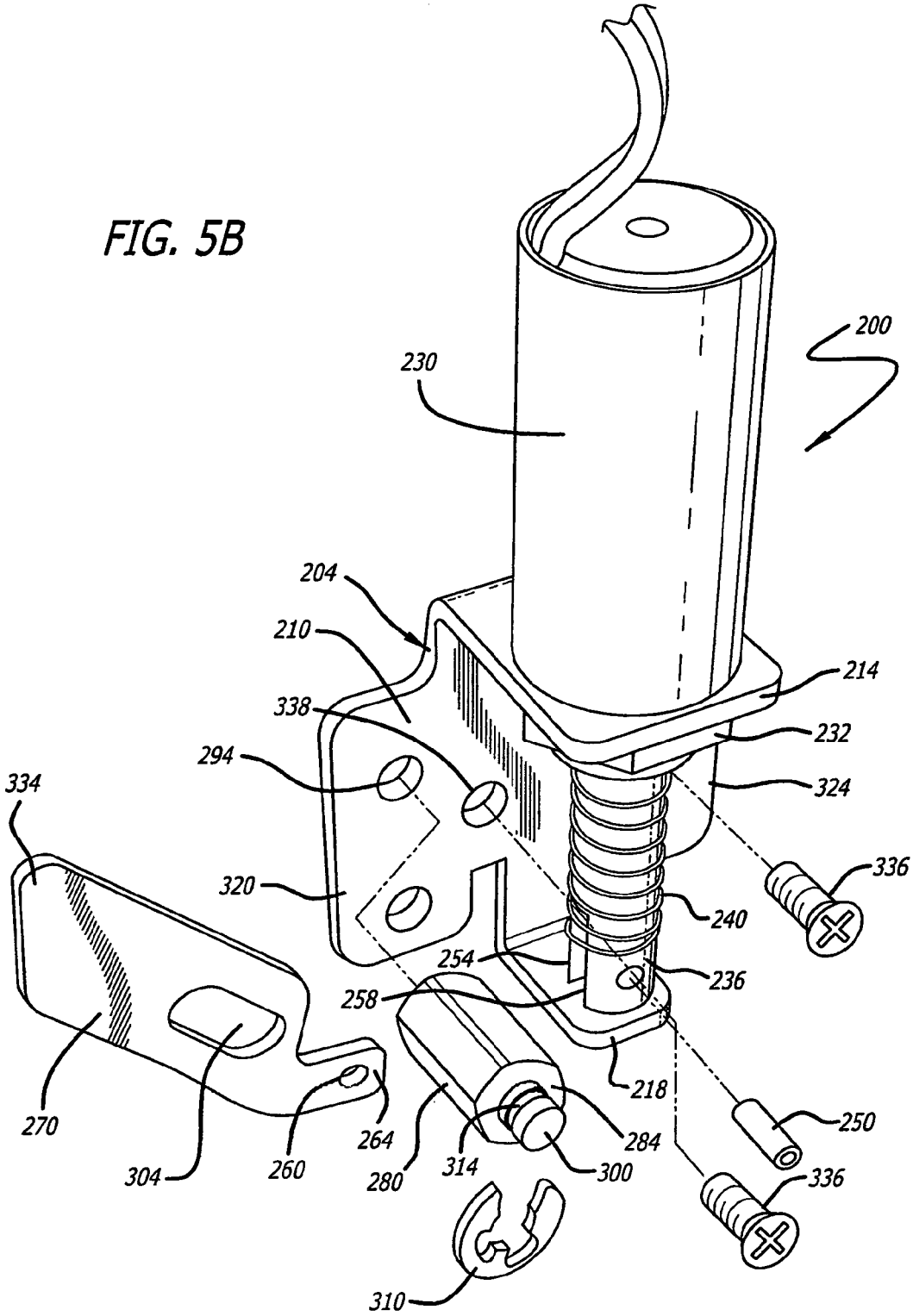
FIG. 5B is an exploded perspective view of the lock assembly of FIG. 5A.
Figure 7:
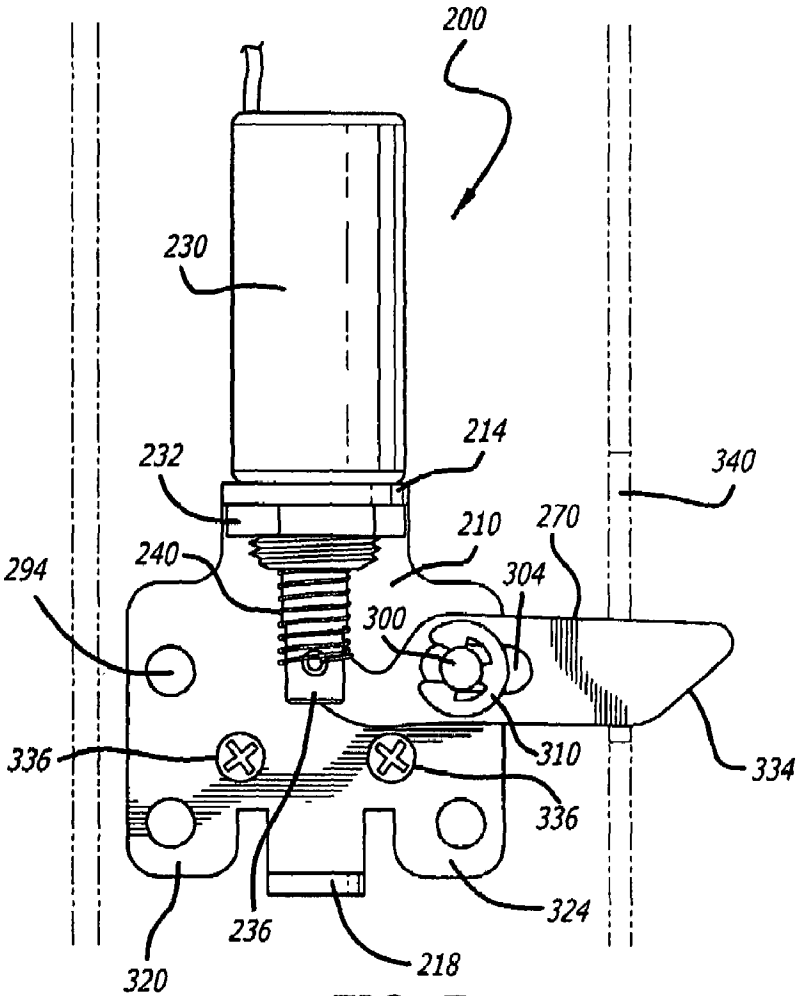
FIG. 7 is a front elevational view of a right-lock alternative of the (left-lock) lock assembly of FIG. 6.
Figure 6:
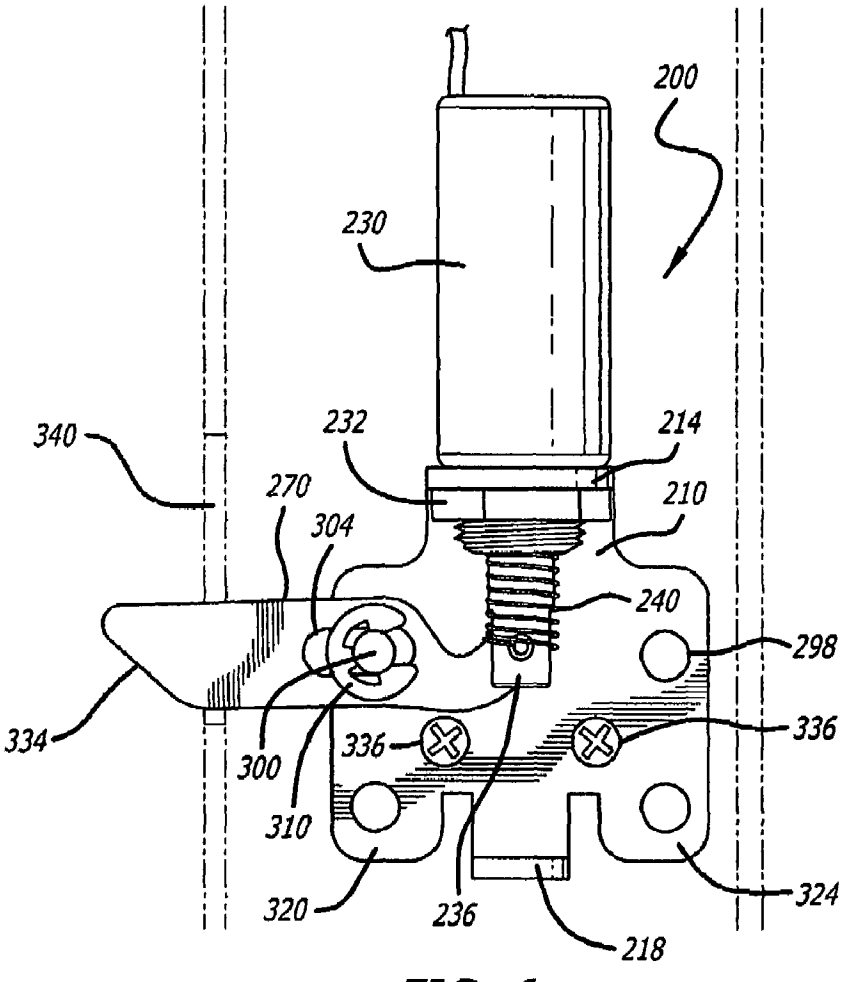
FIG. 6 is a front elevational view of the lock assembly of FIG. 5A (or FIG. 5C) in a locked position.

Many refrigerated display cases have more than one door, such as the display case 50 illustrated in FIG. 1, and each can provide access to the entire interior of the case. Thus, if one door is to be locked they all should be locked. Accordingly, pursuant to the present invention, each door 70, 72, 74 can be equipped with a door lock assembly of the present invention as shown in FIG. 1. All assemblies can be the same construction or one or more can have an alternative construction. For example, one can be the center mullion mounting bracket for mounting inside the frame and another can be a door rail mounting bracket, as illustrated in FIGS. 5A, 5B and 6. The assembly alternative chosen can depend on the mounting location or arrangement. Further, the assembly can have a left-extending bolt or locking arm, such as depicted in FIG. 6, or the right-extending bolt or locking arm, such as that of FIG. 7, depending on the mounting and operation geometries involved.

The electric door lock assembly 200 of FIG. 5A is similar to the door lock assembly 90 of FIG. 2. The electric door lock assembly 200 has a mounting bracket 204 having a back plate 210, an upper flange 214, and a smaller lower flange 218. The upper flange 214 supports the solenoid 230 using a nut 232. The plunger 236 of the solenoid 230 has a return spring 240, a lower slot 244 and a pin 250 which passes through aligned openings 254, 258 in the lower end of the plunger 236 and through an opening 260 (FIG. 5B) in the proximal end 264 of the bolt or locking arm 270. The pin 250 provides a pivotal connection of the arm 270 to the plunger 236.

The pivot pin 280 of this assembly 200 has a slightly different construction but functions the same as that of assembly 90. It has a large body portion 284 with a small end which fits into an opening 294 in the backing plate 210, for a left configuration of FIGS. 5A, 5B and 6. For the right configuration of FIG. 7, the pin 280 is mounted in the opening 298. A pin portion 300 extends out from the body portion 284 and is inserted into the slot 304 of the locking arm 270. A retaining ring 310 fits into a groove 314 on the pin portion 300 and holds the locking arm 270 to the pivot pin 300, while allowing free pivoting and sliding motion of the arm 270 via its slot 304 relative to the pin.

The back plate 210 of this embodiment lacks the long single leg of the other embodiment, but has opposing short legs 320, 324 instead on opposite sides of the abutment plate 218. The angled distal end 334 of the locking arm 270 pivots downwardly and moves outwardly to a locking position as the plunger 236 is retracted. Fasteners 336 through openings 338 in the back plate 210 mount assembly 200 in place.

Figure 5C:
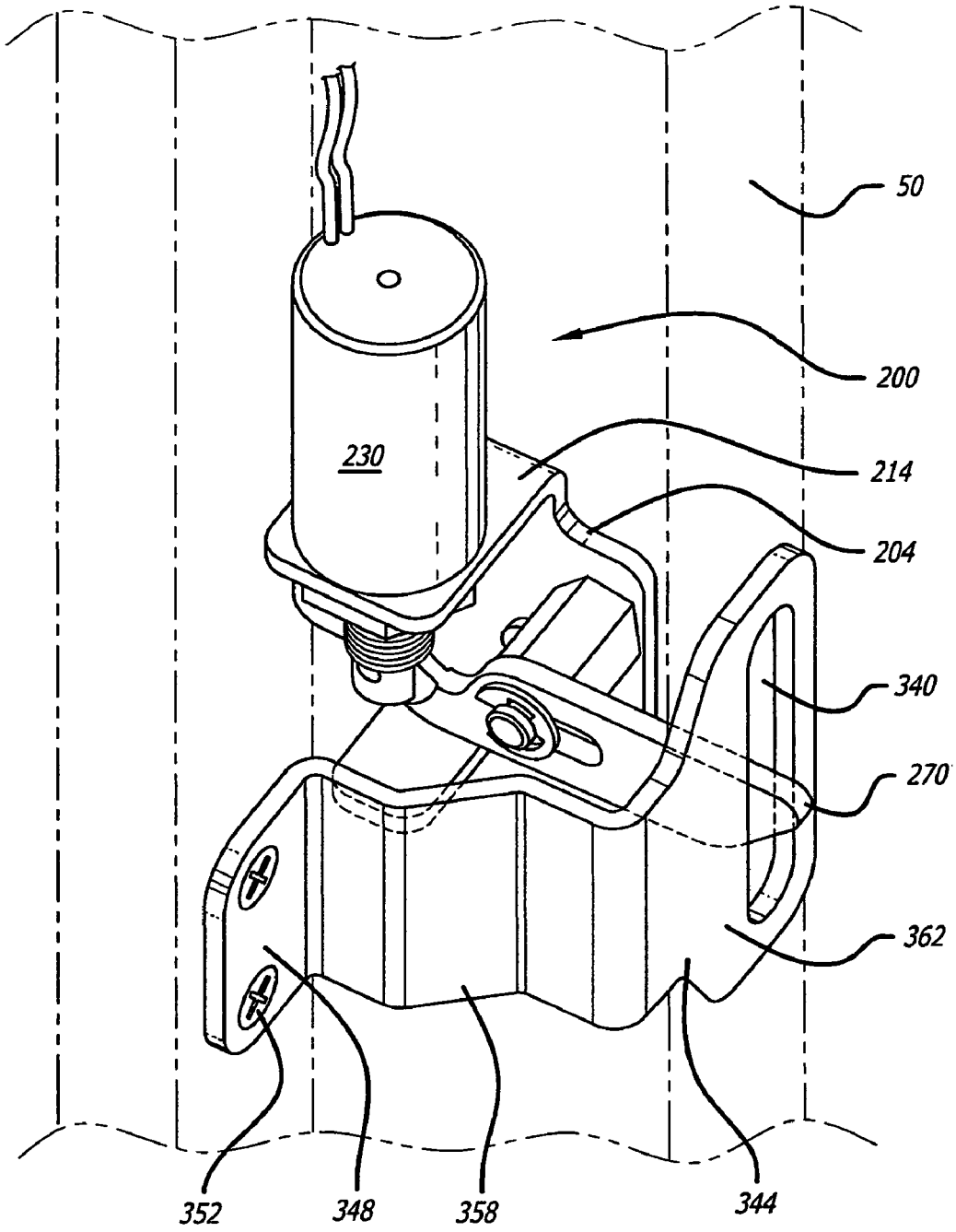
FIG. 5C is a top perspective view of the lock assembly of FIG. 5A shown in a locked position in a keeper member.

When in the locking position, the working end of the locking arm 270 extends into a slot or keeper 340. The keeper can be a sturdy angled member 344 as shown in FIG. 5C having a mounting flange 348 with mounting fastener openings 352, an angled body portion 358 and a working flange 362 having the keeper slot 340. The angled body portion 358 follows the geometries and offsets the working flange 362 relative to mounting flange 348. The keeper member 344 can be mounted to the door and the solenoid mounting bracket 204 can be mounted to the frame.

When a refrigerated display case includes more than one door and more than one door locking assembly, the respective solenoids can be electrically connected as shown schematically in FIG. 1 and controlled by the same programming and energizing mechanism shown generically at 370 so that they are energized and de-energized at the same time. Further, if there is a second, etc. refrigerated display case in the same facility and it is desired to lock its door or doors at the same time as those of the first refrigerated display case, they can also be connected to the same energizing mechanism. It is further within the scope of the invention to remotely and simultaneously energize and de-energize door lock mechanisms in different facilities over the wires or wirelessly. Additionally, the lock assembly 90 or 200 can be used on doors other than those of refrigerated display cases or on structures other than doors, such as covers or lids. The relative positioning of the lock assembly and the keeper to the door and the door frame can also be changed.

Thus, many different alternatives or embodiments of the invention are possible. For example, the plunger can extend up instead of down relative to the solenoid. Instead of a pull-type solenoid, a push-type or even a rotary solenoid can be used. The lock can be unlocked instead of locked when the solenoid is energized. In other words, the lock assembly can be moved to a locking condition by energizing the solenoid (or by de-energizing it). Further, the default condition, such as in the event of a power failure, can be a locked or unlocked condition, as desired, and is preferably the unlocked condition.

From the foregoing detailed description, it will be evident that there are a number of changes, adaptations and modifications of the present invention which come within the province of those skilled in the art. Further, the scope of the invention includes any combination of the elements from the different species or embodiments disclosed herein, as well as subassemblies, assemblies, and methods thereof. It is intended that all such variations not departing from the spirit of the invention be considered as within the scope thereof.

What is claimed is:

1. An electric door lock assembly, comprising:

a mounting bracket;

a solenoid secured to the bracket;

the solenoid having a plunger which has a pivotal connection at the bottom thereof;

a pivot pin secured to the bracket;

a bolt having a longitudinal axis, the bolt pivotally connected at one end to the pivotal connection of the plunger;

wherein the bolt includes an elongated aperture therein along the longitudinal axis of the bolt into which the pivot pin is movably disposed such that when the solenoid moves the plunger, the bolt simultaneously rotates and linearly slides about the pivot pin along the longitudinal axis such that the bolt moves, from an unlocked position to a locked position or from a locked position to an unlocked position.

2. The assembly of claim 1 wherein when the solenoid is energized the plunger moves from an extended position to a retracted position.

3. The assembly of claim 1 wherein the bolt is a planar locking arm and the aperture is a longitudinal through-aperture in the locking arm.

4. The assembly of claim 1 further comprising a standoff on the pivot pin on one side of the bolt and a retaining ring on the pivot pin on the other side of the bolt, the standoff and the retaining ring allowing the aperture to move longitudinally and rotationally relative to the pivot pin.

5. The assembly of claim 1 wherein the solenoid is caused to automatically energize at a predetermined time.

6. An electric door lock assembly, comprising:

a solenoid having a plunger movable between retracted and extended positions;

mounting means for mounting the solenoid so that the plunger is vertically disposed and operatively moves along a vertical axis between the retracted and extended positions;

a locking arm pivotally connected at a proximal end thereof to the plunger, the locking arm having a longitudinal axis and an elongated aperture longitudinally disposed therein; and pivoting means disposed in the elongated aperture for causing simultaneous rotational and linear pivoting of the locking arm relative to a horizontal axis as the plunger moves between the retracted and extended positions such that a distal end of the locking arm moves between unlocked and locked positions.

7. The assembly of claim 6 wherein the pivoting means includes a pivot pin disposed in the longitudinal elongated aperture and whose axis is fixedly positioned relative to the solenoid.

8. The assembly of claim 7 wherein the mounting means includes a mounting bracket and the pivot pin is mounted to and extends out from the mounting bracket.

9. The assembly of claim 6 wherein the solenoid is caused to automatically energize or de-energize at a predetermined time on one or more predetermined days.

10. A refrigerated display case system, comprising:

a refrigerated display case having a wall which has at least one customer access opening;

a first door movable between open and closed positions relative to the customer access opening; and a first electric door lock assembly which includes a first mounting bracket mounted to the first door or the wall, a first solenoid secured to the first bracket, the first solenoid having a first plunger, a first pivot pin secured to the first bracket, a first bolt pivotally connected at one end by a first pivotal connection to the first plunger, the first bolt having a first elongated aperture longitudinally disposed therein into which the first pivot pin is disposed, such that when the first solenoid is energized or de-energized, the first plunger moves from an extended position to a retracted position, which causes the first bolt to pivot about the first pivotal connection and the first bolt to simultaneously rotate and linearly slide along its longitudinal axis relative to the first pivot pin such that the first bolt moves from an unlocked position to a locked position.

11. The system of claim 10 wherein the door is a transparent thermally-insulated door allowing customers to view products in the refrigerated display case when the door is in the closed position.

12. The system of claim 10 wherein the solenoid is caused to energize automatically at a predetermined time of the day.

13. The system of claim 10 wherein the aperture is an elongated through-aperture.

14. The system of claim 10 wherein the refrigerated display case has at least a first and a second customer access opening, the first door movable between open and closed positions relative to the first customer access opening further comprising:

a second door movable between open and closed positions relative to the second customer access opening; and a second electric door lock assembly which includes a second mounting bracket mounted to the second door or the wall; a second solenoid secured to the second bracket; the second solenoid having a second plunger; a second pivot pin secured to the second bracket; a second bolt pivotally connected at one end by a second pivotal connection to the second plunger; the second bolt having a second elongated aperture longitudinally disposed therein into which the second pivot pin is disposed, such that when the second solenoid is energized or de-energized, the second plunger moves from an extended position to a retracted position, which causes the second bolt to pivot about the second pivotal connection and the second bolt to simultaneously rotate and linearly slide along its longitudinal axis relative to the second pivot pin such that the second bolt moves from an unlocked position to a locked position.

15. The system of claim 14 further comprising means for energizing and deenergizing the first and second solenoids at the same time.

16. The system of claim 14 wherein the first and second solenoids are automatically energized and/or deenergized at the same predetermined time.

17. A door lock assembly, comprising:

a pivot pin secured to and extending out from a lock assembly mounting structure;

a bolt having a longitudinal axis, a proximal end, a distal end and an longitudinally disposed elongated aperture in which the pivot pin is disposed; and means for moving the proximal end up and down to thereby cause the bolt to linearly slide along its longitudinal axis and rotate relative to the pivot pin such that distal end of the bolt moves between locked and unlocked positions.

18. The assembly of claim 17 wherein the moving means is a solenoid having a plunger to which the proximal end of the bolt is pivotally attached.

19. The assembly of claim 18 wherein the solenoid automatically energizes and deenergizes at predetermined times.

20. The assembly of claim 17 wherein the bolt is a planar locking arm and the elongated aperture is a longitudinal through-aperture in the locking arm.

21. The electric door lock assembly of claim 1 further comprising an electronic control coupled to the solenoid for energizing and deenergizing the solenoid.

22. The electric door lock assembly of claim 1 further comprising means for remotely energizing and deenergizing the solenoid.

23. The electric door lock assembly of claim 6 further comprising an electronic control coupled to the solenoid for energizing and deenergizing the solenoid.

24. The electric door lock assembly of claim 6 further comprising means for remotely energizing and deenergizing the solenoid.

25. The electric door lock assembly of claim 10 further comprising an electronic control coupled to the solenoid for energizing and deenergizing the solenoid.

26. The electric door lock assembly of claim 10 further comprising means for remotely energizing and deenergizing the solenoid.

27. The electric door lock assembly of claim 17 further comprising an electronic control coupled to the solenoid for energizing and deenergizing the solenoid.

28. The electric door lock assembly of claim 17 further comprising means for remotely energizing and deenergizing the solenoid.

* * * * *